US006640899B2

(12) United States Patent
Day et al.

(10) Patent No.: US 6,640,899 B2
(45) Date of Patent: Nov. 4, 2003

(54) APPARATUS AND METHODS FOR JARRING

(75) Inventors: Cory D. Day, Burleson, TX (US); Ronnie Day, Burleson, TX (US); Cameron Jackson, Burleson, TX (US)

(73) Assignee: Core Laboratories, L.P., Houston, TX (US)

( * ) Notice: Subject to any disclaimer, the term of this patent is extended or adjusted under 35 U.S.C. 154(b) by 0 days.

(21) Appl. No.: 09/982,919

(22) Filed: Oct. 18, 2001

(65) Prior Publication Data

US 2003/0075329 A1 Apr. 24, 2003

(51) Int. Cl.[7] ..... E21B 31/00
(52) U.S. Cl. ..... 166/301; 166/278
(58) Field of Search ..... 166/301, 278, 166/377; 175/293, 301

(56) References Cited

U.S. PATENT DOCUMENTS 4,845,494 A * 7/1989 Hanson et al. ..... 340/854.5
5,267,613 A * 12/1993 Zwart et al. ..... 166/178
5,330,018 A * 7/1994 Griffith ..... 175/299
6,308,779 B1 * 10/2001 McNeilly et al. ..... 166/301

* cited by examiner

*Primary Examiner*—David Bagnell
*Assistant Examiner*—Jennifer Dougherty
(74) *Attorney, Agent, or Firm*—Madan, Mossman & Sriram, P.C.

(57) ABSTRACT

A jarring tool uses a button member to control the jarring sequence used to free an object lodged in a well bore. A preferred tool includes an anvil having a sleeve portion adapted to enter a bore of a hammer. The button member allows selective entry of the anvil sleeve into the hammer bore. A preferred telemetry link includes two or more at least partially conductive members in a telescopic relationship for exchanging electrical signals with the object. The members extend and retract to accommodate length changes of the jarring tool. An exemplary jarring sequence includes a loading phase, a release phase, and a reset phase. In the loading phase, the button member prevents hammer movement toward the anvil. During the release phase, the button member allows the hammer to be propelled against the anvil. In the reset phase, the hammer and button returns to their initial positions.

20 Claims, 6 Drawing Sheets

APPARATUS AND METHODS FOR JARRING

FIELD OF THE INVENTION

The present invention relates to tools adapted to recover objects lodged within a well bore. More particularly, the present invention relates to a jarring apparatus that delivers controlled percussive impact to a lodged object. In a different aspect, the present invention relates to an apparatus that provides a telemetry link to the lodged object during the jarring sequence.

GENERAL BACKGROUND OF THE INVENTION

During the course of drilling, completing, testing or working over a well for producing hydrocarbons, objects may become stuck within a well bore through which the hydrocarbons are recovered. Objects that can become lodged or otherwise immobile relative to a well bore can include drilling equipment, tool strings, bottomhole assemblies or other items typically conveyed into a well bore environment. In order to loosen and recover these objects, jars have been developed that have the effect of providing a jarring impact to the object.

Conventional jarring tools usually use either a mechanical or hydraulic system to loosen and dislodge a stuck object. Conventional hydraulic jars have a piston disposed in a cylinder that is filled with hydraulic oil. The piston, or jar rod, is accelerated by hydraulic fluid through a stroke. At the completion of the stroke, an impact force is delivered to the jar housing. One disadvantage of hydraulic jars involves the difficulties associated with maintaining a hydraulic fluid system in a downhole environment. These systems typically use pumps, reservoirs, fluid conduits, seals that can be expensive to incorporate into downhole tooling and can require frequent maintenance.

Mechanical jars, like hydraulic jars, typically use a piston-cylinder arrangement. The piston, however, is driven or propelled by a device such as a Bellville washer stack or other mechanical biasing mechanism. Often, the spring is compressed by pulling up on a work string until a desired spring force is reached. This spring force is then used to accelerate a piston that strikes the jar housing. Some jarring tools utilize means to reset the piston to deliver a second impact if needed. Conventional mechanical jars, however, do not satisfactorily control the delivery of the impact force nor provide a reliable arrangement to reset the jar tool.

Further, conventional jar tools are usually interposed in a string, such as a wireline or work string, that incorporates a telemetry system for communicating with one or more tools attached to the string. It is often desirable to maintain communication with these tools even when the jarring tool is activated. Conventional tool strings often use a telemetry cable that has one or more coiled portions that expand to provide added length to accommodate the extension of the jarring tool. Such devices, however, have not provided a reliable telemetry connection with the downhole tools.

The present invention addresses these and other disadvantages of conventional jarring tools.

SUMMARY OF THE INVENTION

The present invention provides an apparatus for providing a percussive or jarring force to an object having at least a portion thereof lodged in a well bore. In a preferred embodiment, the apparatus includes anvil, a hammer, and a button member. The anvil includes a sleeve and is connected to the object with a mandrel. The hammer includes an axial bore that can receive a portion of the anvil sleeve and a transverse bore in which the button member is disposed. The button member has a first position wherein the anvil sleeve cannot enter the hammer axial bore and a second position wherein the button allows the anvil sleeve to enter the hammer axial bore. The button member is actuated by a trigger that moves the button member from the first position to the second position. A spring member provided on the hammer urges the button member from the second position to the first position. Preferably, a housing encloses at least a portion of the hammer and the anvil. The housing has a first section, a second section, and a frangible member connecting the first and second sections. The frangible member is preferably a shear screw that disintegrating upon encountering a pre-determined force. Upon disintegration, the first section can move axially away from the second section. The preferred apparatus also includes a telemetry link for exchanging electrical signals with the object. In a preferred arrangement, the telemetry link includes at least one inner tube telescopically disposed within at least one outer tube. At least a portion of the inner tube and outer tube are formed of a conductive material. The inner tube is drawn out of the outer tube when the housing first section moves axially away from the housing second section.

During use, the preferred apparatus provides one or more jarring or percussive impacts to the object. An exemplary jarring sequence includes an activation phase, a loading phase, a release phase, and a reset phase. During the activation phase, an axial traction force is imposed on the tool housing to separate the two housing sections. In the loading phase, the first housing section moves axially away from the object and causes a piston to compress a biasing member. The button member, which is in the first position, prevents the hammer from sliding toward the anvil. A release phase is entered when a trigger provided on the housing first section moves the button member from the first position to the second position. Once the button member is in the second position, the biasing member accelerates the freed hammer axially against the anvil. The percussive impact of the hammer is transferred from the anvil to the object through a mandrel. If this action does not free the object, the apparatus is put into the reset phase. In this phase, the first housing section is permitted to slide axially towards the second section. This movement returns the hammer to its initial position and allows the button member to return to its first position. With the hammer and anvil interlocked by the button member, the jarring sequence can be again performed.

The axial length changes of the housing during the several phases of the jarring sequence are accommodated by the telescoping feature of the telemetry link. During separation of the housing sections, the inner tube of the telemetry link is extracted out of the outer tube. As the first housing section moves toward the second section, the inner tube slides into the outer tube. Thus, during all phases of the jarring sequence, a reliable telemetry communication path is maintained with the stuck object.

It should be understood that examples of the more important features of the invention have been summarized rather broadly in order that detailed description thereof that follows may be better understood, and in order that the contributions to the art may be appreciated. There are, of course, additional features of the invention that will be described hereinafter and which will form the subject of the claims appended hereto.

BRIEF DESCRIPTION OF THE DRAWINGS

A better understanding of the present invention can be obtained when the following detailed description of exemplary embodiments are considered in conjunction with the following drawings, in which.

DETAILED DESCRIPTION OF THE PREFERRED EMBODIMENTS

Figure 1:
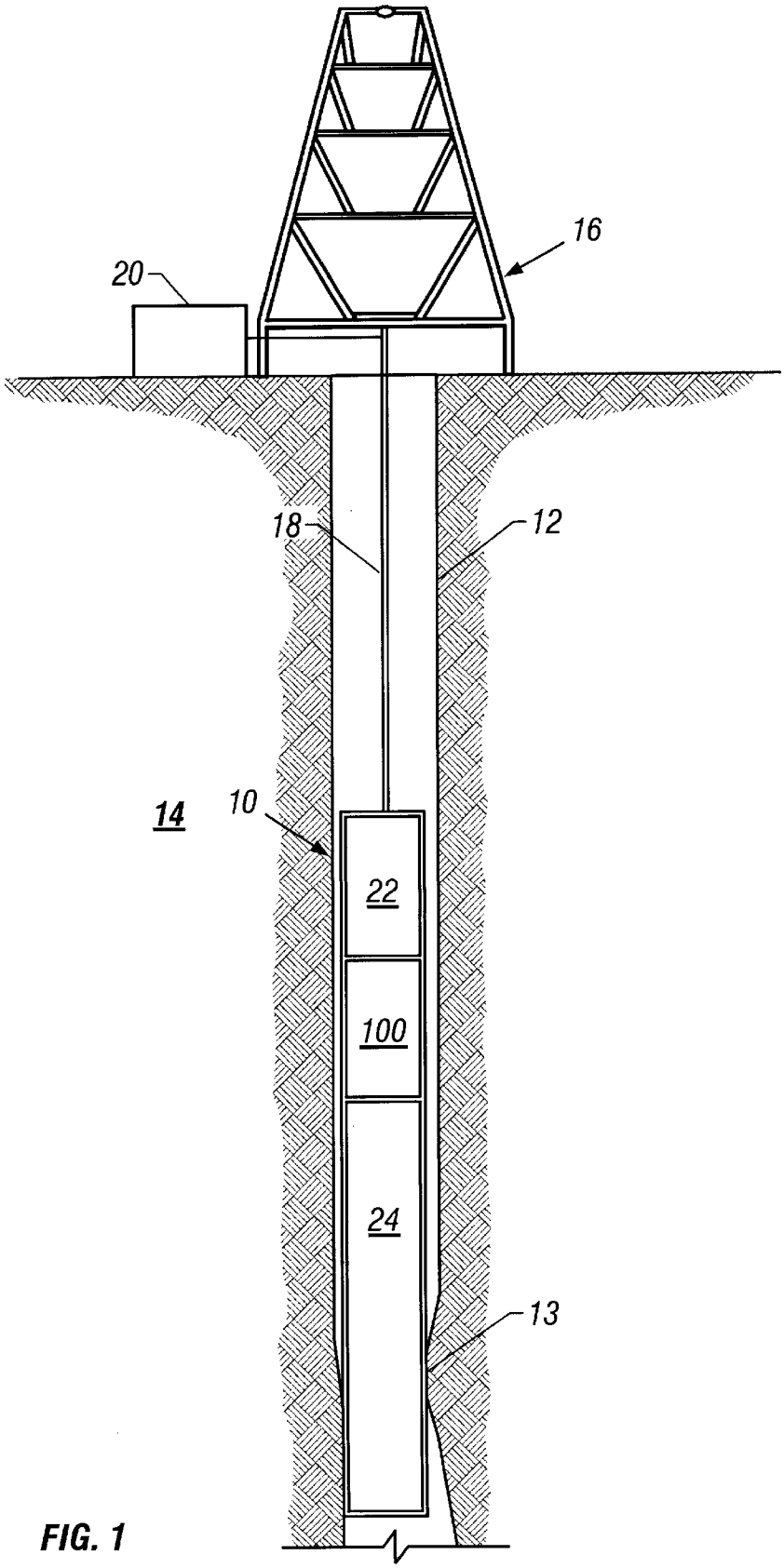
FIG. 1 is an elevation view of a preferred embodiment of the present invention used in conjunction with a conventional tool string disposed in a well bore.

In the description that follows, like parts are marked throughout the specification and drawings with the same reference numerals, respectively. The drawing figures are not necessarily drawn to scale and certain figures may be shown in exaggerated or generalized form in the interest of clarity and conciseness.

The present invention relates to devices and methods for providing a percussive or jarring force to an object lodged in a well bore. Such an object may be tooling or equipment used during any phase of hydrocarbon recovery, including drilling, completion and production. For simplicity, the present invention will be described in the context of a tool string that may include, for example, wireline tools, a bottom hole assembly, or completion equipment such as perforating guns. The present invention, thus, is susceptible to embodiments of different forms. There are shown in the drawings, and herein will be described in detail, specific embodiments of the present invention with the understanding that the present disclosure is to be considered an exemplification of the principles of the invention, and is not intended to limit the invention to that illustrated and described herein.

Referring initially to FIG. 1, there is shown a conventional tool string 10 disposed in a well bore 12 formed in a subterranean formation 14. A surface structure 16 supports the tool string 10 in the well bore 12 with a work string or suspension line 18. The tool string 10 can be a single tool or a package of tools that include known equipment and instrumentation adapted to perform functions such as detecting geophysical characteristics (e.g., porosity, gamma radiation, resistivity, etc.) and determining tool orientation. The tool string 10 can also include a telemetry system that communicates with surface equipment 20 via the telemetry wires (not shown) in the suspension line 18. For convenience, the tool string 10 is shown as having an upper section 22 and a lower section 24. During deployment of the wireline 10, the tool string lower section 24 may become stuck in a well bore restriction or obstruction, the obstruction being generally denoted with numeral 13. An exemplary jarring tool 100 made in accordance with the present invention provides a controlled and, if needed, repeated percussive or jarring force that dislodges the tool string lower section 24 from the obstruction 13 and thereby frees the tool string 10. In a preferred arrangement, the jarring tool 100 is interposed between the upper section 22 and lower section 24 of the tool string 10.

Figure 2:
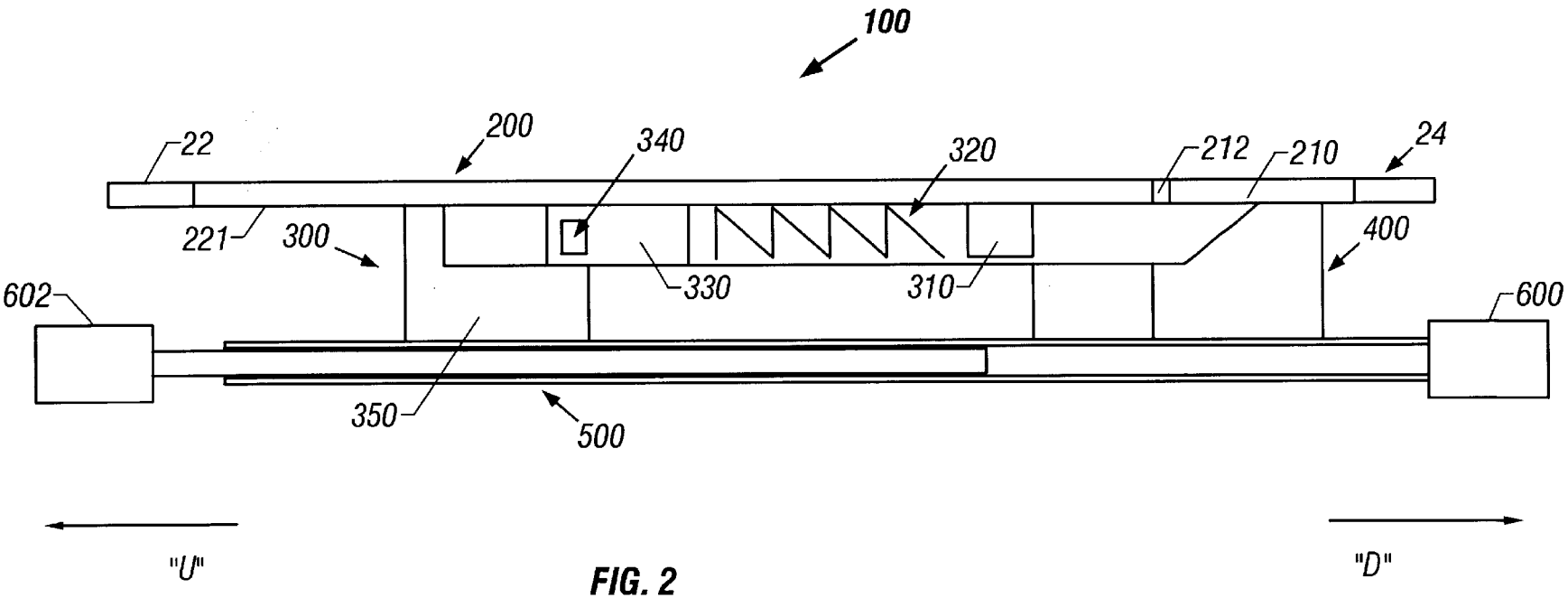
FIG. 2 is a schematic illustration of a preferred jarring tool.

Referring now to FIG. 2, there is a strictly schematic illustration of a jarring tool 100 attached at opposing ends to the tool string upper section 22 and lower section 24. It will be apparent that FIG. 2 merely provides a convenient means to illustrate the interaction and general arrangement of the various exemplary features of the preferred jarring tool 100. For convenience, the arrow labeled "U" denotes an uphole direction and the arrow labeled "D" denotes the downhole direction. The jarring tool 100 of the present invention may be adapted to provide a jarring force to the tool string 10 in either or both of the uphole ("U") and downhole ("D") directions. For simplicity, the embodiment of the jarring tool 100 described below is directed to dislodging a tool string 10 by providing a controlled jarring force in the "U" direction. A jarring tool 100 so adapted includes a housing 200, a jarring assembly 300, a mandrel assembly 400 and a telemetry link 500.

Figure 3:
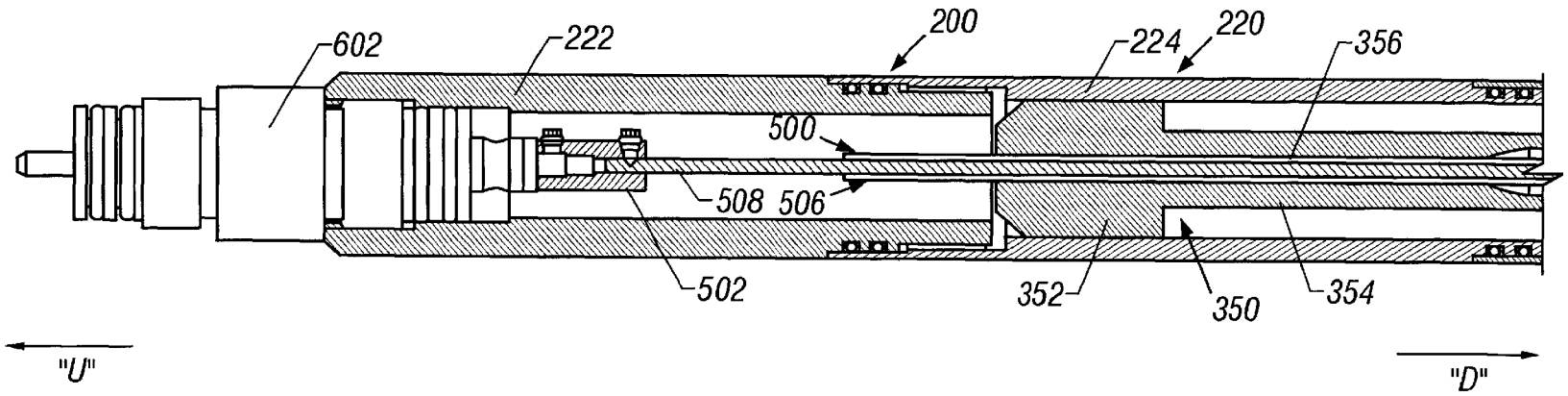
FIG. 3 is cross-sectional side view of a section of the preferred jarring tool that includes an exemplary telemetry system, anvil and associated components.
Figure 6:
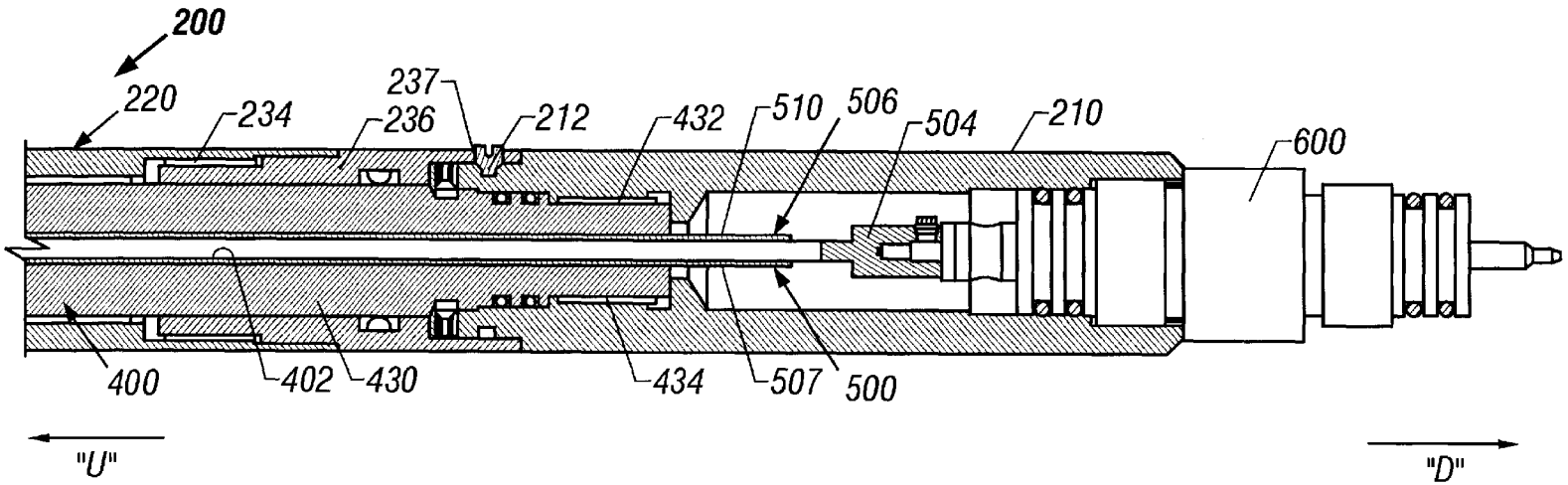
FIG. 6 is cross-sectional side view of a section of the preferred jarring tool that includes an exemplary telemetry system, separator housing, bottom sub and associated components.

The housing 200 of the jarring tool 100 provides a mechanical connection between the upper and lower sections 22,24 of the tool string 10 during normal operations. Referring now to FIGS. 2,3 and 6, a preferred housing 200 includes a bottom sub 210, a frangible member 212, and an upper assembly 220. The bottom sub 210 attaches to an adapter 600 associated with the tool string lower section 24 via known devices such as threaded connection. Likewise, the upper assembly 220 attaches to an adapter 602 associated with the tool string top portion 24 via known devices such a threaded connection. The bottom sub 210 and upper assembly 220 are connected to each other, however, with at least one frangible member 212. Referring now to FIG. 6, the bottom sub 210 has a substantially rigid connection to the mandrel assembly 400, the details of which will be discussed below.

Referring still to FIG. 6, the frangible member 212 allows the bottom sub 210 to separate from the upper assembly 220 when the adaptor 600/tool string lower section 24 become stuck in the well bore 12 (FIG. 1). The frangible member 212 is preferably a device such as one or more shear screws that snap or otherwise disintegrate upon encountering a predetermined load. This pre-determined load may be produced by pulling the upper assembly 220 in a generally "U" direction while the bottom sub 210, and connected tool string lower section 24, are stuck in the well bore 12 (FIG. 1). The arrangement used to connect the bottom sub 210 to the upper assembly 220 can also utilize a shear pin (not shown), a spring-biased detent ball, or chemical compounds or materials that disintegrate or release under known loading conditions. Alternatively, an electro-mechanical locking device (e.g., a solenoid), which can be energized by surface personnel, may be used. In any event, the present invention is not limited to any particular device or material for connecting the bottom sub 210 to the upper assembly 220. It should be understood that the frangible member 212 may not be needed in certain arrangements where the tool may be operated without the necessity of separating the housing 200.

Referring back to FIG. 2, the upper assembly 220 is a generally tubular structure having a central passage 221 that is adapted to enclose the jarring assembly 300. Referring now to FIGS. 3–6, the upper assembly 220 is formed of a plurality of interconnected housings including a top sub 222 (FIG. 3), an anvil housing 224 (FIG. 3), a hammer housing 226 (FIG. 4), a trigger housing 228 (FIG. 4), a spring housing 230 (FIGS. 4–5), a first piston housing 232 (FIG. 5), a second piston housing 234 (FIGS. 5–6), and a separator housing 236 (FIG. 6). The construction of housings 222–236 are known in the art and utilize known features such as corrosion resistant metals, threaded pin-box connections and sealing members such as elastomeric "O"-rings. Accordingly, such general features will not be discussed in detail. It will be appreciated that the jarring tool 100 may be several feet in length. Accordingly, for ease of fabrication, handling, assembly, and maintenance, it is preferred that the upper assembly 220 be formed of a plurality of housings. Depending on the desired application, however, greater or fewer housings may be used.

The housings 222–236 include one or more features that cooperate with other components, e.g., the jarring assembly 300, to perform one or more functions. For example, the separator housing 236 (FIG. 6) includes one or more bores 237 adapted to receive the frangible member 212, and the trigger housing 228 (FIG. 4) includes an inwardly projecting trigger ledge 229. Additionally, the anvil housing 224 (FIG. 4) has a pin end 225 having an inner diameter slightly smaller than the diameter of the passage 221. For clarity, the functions these features are described in the discussion of the components with which they coact.

Referring back to FIG. 2, the jarring assembly 300, when activated, delivers a jarring force to the tool string lower section 24 via the mandrel assembly 400. Preferably, the jarring assembly 300 is disposed within the central passage 221 and includes a piston head 310, a biasing member 320, a hammer 330, a button member 340, and an anvil 350. As will become apparent, the jarring assembly 300, during the jarring sequence, produces a spring force in the biasing member 320 that is used to propel the hammer 330 against the anvil 350.

Figure 4:
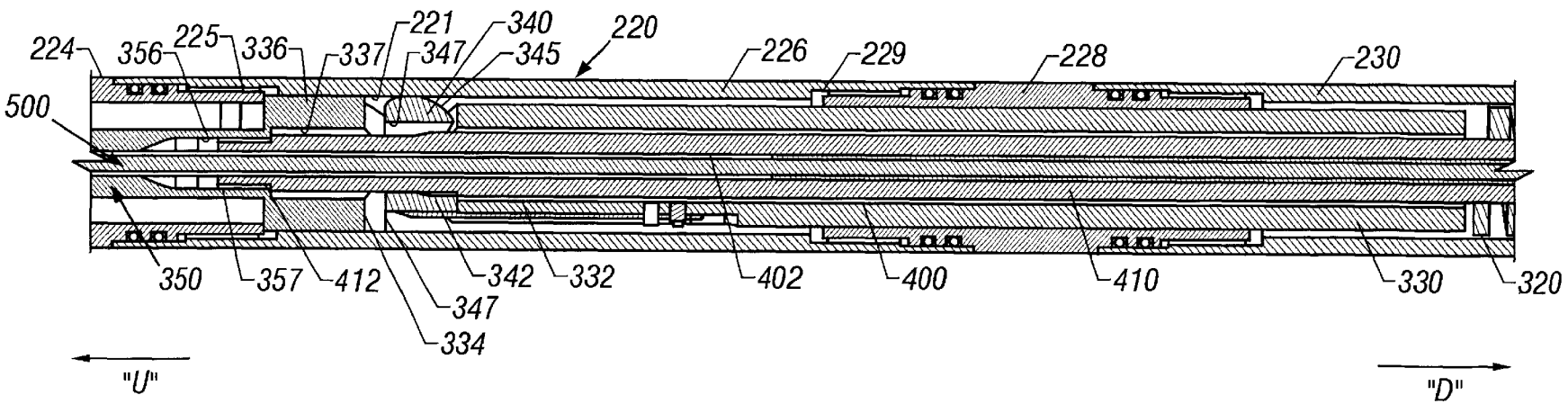
FIG. 4 is cross-sectional side view of a section of the preferred jarring tool that includes an exemplary hammer, biasing member, mandrel assembly and associated components.
Figure 5:
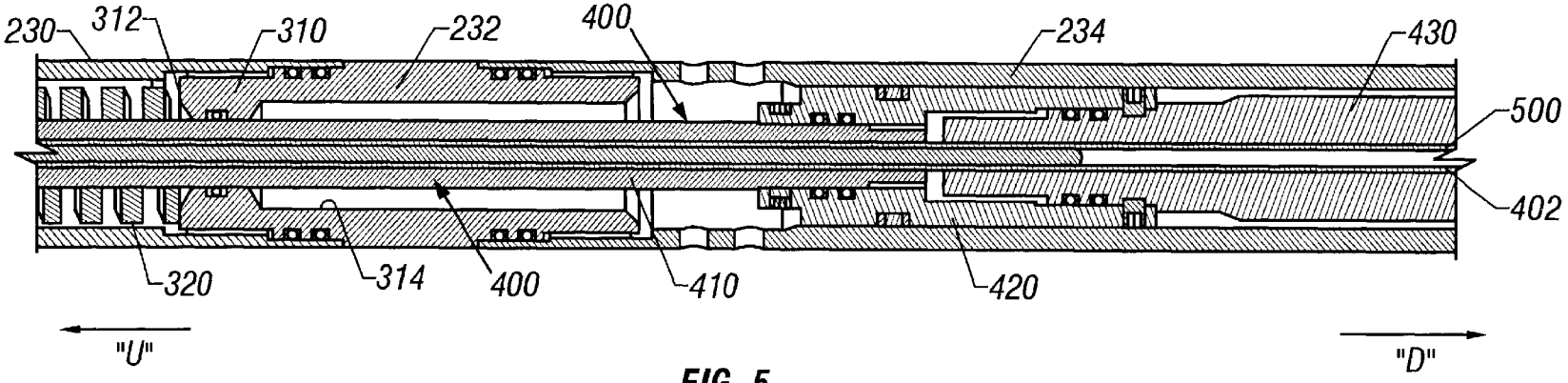
FIG. 5 is cross-sectional side view of a section of the preferred jarring tool that includes an exemplary biasing member, trigger housing, mandrel assembly and associated components.

Referring now to FIGS. 4 and 5, the piston head 310 is adapted to compress the biasing member 320 against the hammer 330. The piston head 310 is preferably formed integral with the first piston housing 232. The piston head 310 includes a transverse planar surface 312 that abuts the biasing member 320 and a passage 314 for receiving the mandrel assembly 400. Thus, the piston 310 can slide axially along the outer surface of the mandrel assembly 400.

The biasing member 320 provides a pre-determined amount of propelling force to the hammer 330. The biasing member 320 is interposed between the piston head 310 and the hammer 330. As will be explained below, the hammer 330 is held stationary during a portion of the jarring sequence. Axial movement of the piston head 310 compresses the biasing member 320 against the stationary hammer 330 and thereby generates the propelling force. The biasing member 320 includes at least one coil spring, but preferably two or more coil springs, that surround the mandrel assembly 400. It will be understood that the magnitude of the spring force will depend on factors such as the size and number of the springs and the axial distance (i.e., the stroke) the springs are compressed. By changing the number of the springs, or selecting springs having a particular spring constant, the biasing member 320 may be customized to provide a selected amount of jarring force for a particular tool string. Other biasing mechanisms, such as Bellville springs or compressible fluids such as gas, may also prove effective in certain applications.

Referring now to FIGS. 3 and 4, the hammer 330, when accelerated by the propelling force provided by the biasing member 320, delivers a high-energy percussive or jarring force to the anvil 350. Application of this jarring force displaces the anvil 350 in the generally "U" direction. The hammer 330 is elongated cylindrical member that is adapted to reciprocate along a pre-determined stroke within the central passage 221 of the housing upper assembly 220. The hammer 330 includes an axial bore 332, a transverse bore 334, and a head 336. The axial bore 332 permits the hammer 330 and the anvil 350 to engage in a piston-cylinder-type fashion that is described below. The head 336 has an outer diameter slightly larger than the pin end 225 of the anvil housing 224 and includes a passage 337 that is formed to receive and guide the anvil 350 into the axial bore 332. The interfering relationship caused by the different diameters of the pin end 225 and the hammer head 336 allows the anvil housing 224 to urge the hammer 330 in the "D" direction, when needed. The transverse bore 334 is shaped complementary to and receives the button member 340. Preferably, the hammer 330 is formed of a relatively durable material, such as stainless steel, and is massive enough, when accelerated, to deliver a percussive force for displacing the anvil 350.

Figure 7:
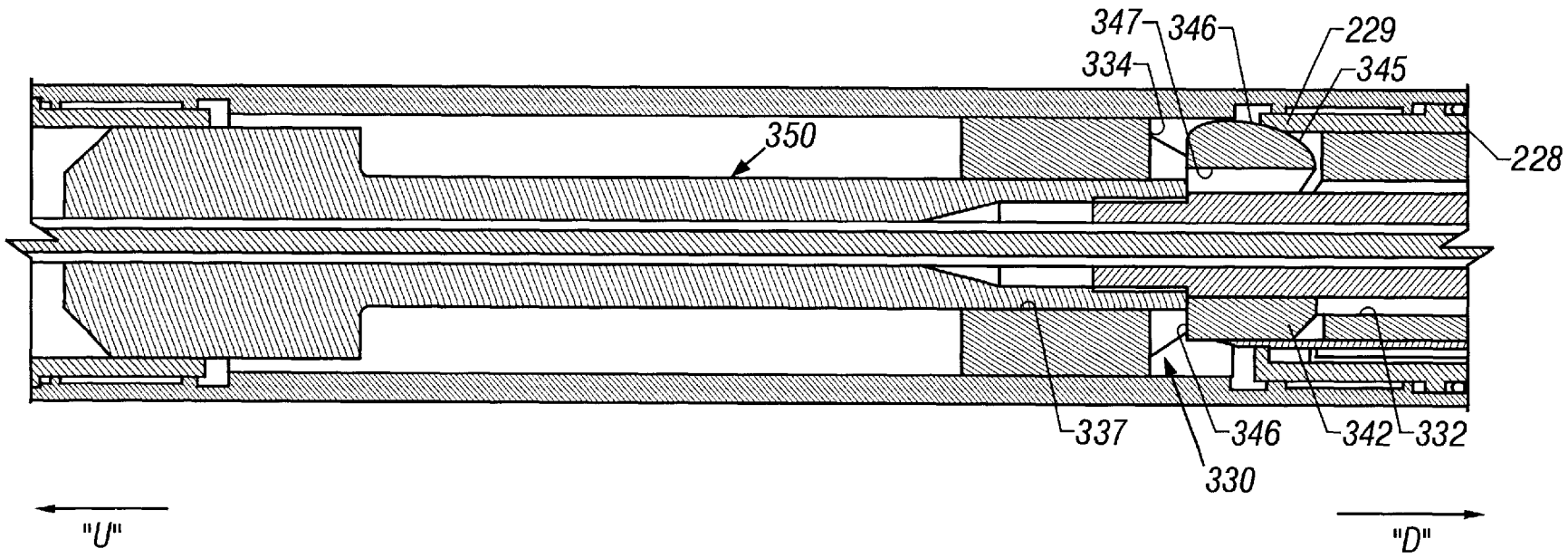
FIG. 7 illustrates a cross-sectional side view of a preferred button member in a first position.
Figure 8:
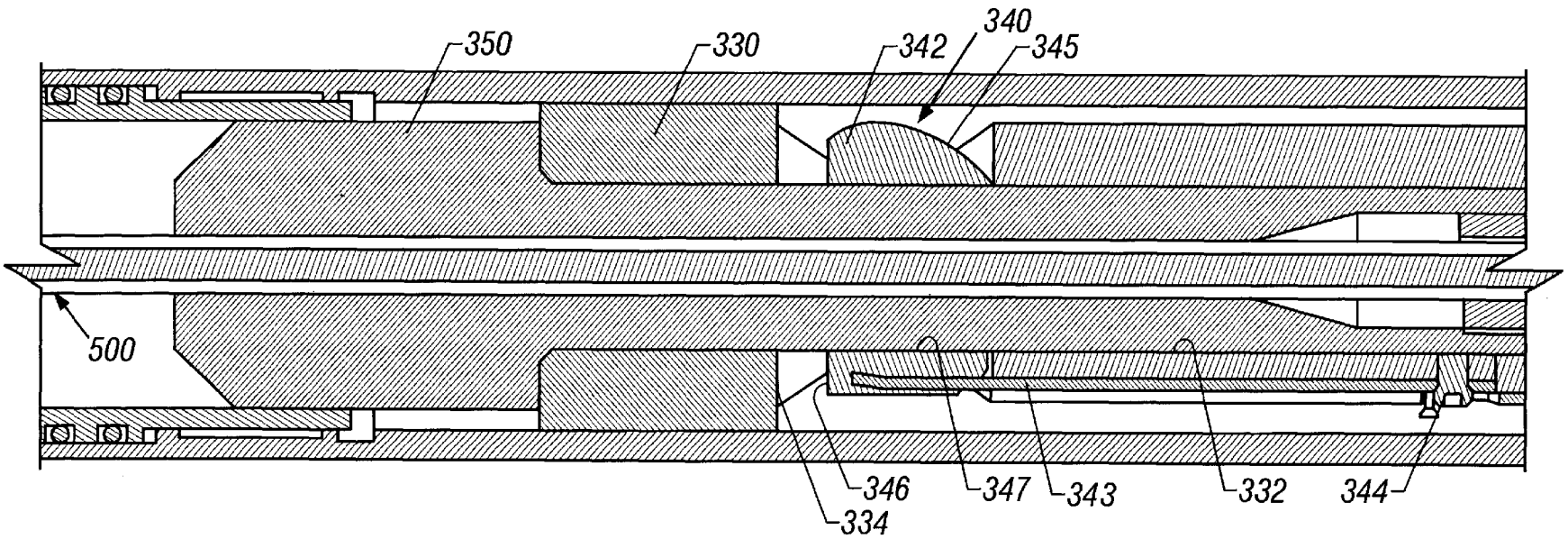
FIG. 8 illustrates a cross-sectional side view of a preferred button member in a second position.

Referring now to FIG. 4, the button member 340 provides selective and controlled delivery of the jarring force produced by the jarring assembly 300. The button member 340, which is disposed within the hammer transverse bore 334, has a first position and a second position. In the first position, as shown in FIG. 4, the button member 340, during normal operations, does not play an active roll in maintaining a particular relationship between the hammer 330 and the anvil 350. Referring now to FIG. 7, the button member 340 is still shown in the first position. The hammer 330, however, has been displaced in the "U" direction by the biasing member 320 (FIG. 4) such that the anvil 350 has entered the hammer head passage 337 and abuts the button member 340. In this instance, the button member 340 prevents the hammer 330 from further axial travel toward the anvil 350. Referring now to FIG. 8, the button member 340 is shown in the second position wherein the hammer 330 is allowed to slide along a portion of the anvil 350.

Referring now to FIG. 4, a preferred button member 340 includes a collar 342, a spring member 343, and fasteners 344. The spring member 343 retains the collar 342 within the transverse bore 332 and provides a biasing force that urges the collar 342 from the second position to the first position show in FIG. 4. The spring member 343 is fixed at one end to the hammer 330 with fasteners 334 and attached at the other end to the collar 342 using known means such as fasteners or a weld.

Referring now to FIGS. 4 and 7, the collar 342 is a dowel-like structure having an arcuate portion 345, a shoulder portion 346, and a passage 347. When the button member 340 is in the first position, the arcuate portion 345 protrudes out of the transverse bore 334 and the shoulder portion 346 partially blocks the hammer axial bore 332. As shown in FIG. 7, the radial offset between collar passage 347 and the hammer axial bore 332 provides a mechanical interference that prevents the anvil 350 from entering the axial bore 332 of the hammer 330. Referring now to FIG. 8, when the button member 340 is in the second position, the collar passage 347 radially aligns with the axial bore 332, thereby allowing the anvil 350 to enter the axial bore 332 via the collar passage 347. Referring briefly to FIG. 7, the trigger ledge 229 is positioned to impinge the arcuate portion 345 of the collar 342 when the trigger housing 228 moves in the "U" direction relative to the hammer 330. As can be appreciated, the arcuate portion 345 acts as a ramp that facilitates smooth contact between the trigger ledge 229 and the collar 342. The interfering contact between the ledge 229 and the collar 342 forces the collar 342 to be depressed into the transverse bore 334, thereby moving the collar 342 from the first position to the second position.

Referring now to FIGS. 3 and 4, the anvil 350 transfers the jarring force delivered by the hammer 330 to the tool string lower section 24 via the mandrel assembly 400. The anvil 350 includes a base 352, a reduced-diameter sleeve portion 354, and a passage 356. The base 352 is preferably configured to withstand repeated impact of the hammer head 336. The sleeve portion 354 extends axially from the base 352 and provides a support surface on which the hammer 330 slides. The anvil passage 356 includes an internally threaded portion 357 for engaging the mandrel assembly 400. The anvil passage 356 is further adapted to receive the telemetry link 500. The sleeve portion 354 is shaped to enter the collar passage 347 and the axial bore 332 when these two openings are aligned.

Referring now to FIGS. 4–6, the mandrel assembly 400 provides a generally rigid structure that transmits the jarring force produced by the jarring assembly 300 to the tool string lower section 24. The mandrel assembly 400 includes a spring mandrel 410 (FIG. 4), an intermediate piece 420 (FIG. 5), and a lower mandrel 430 (FIG. 6). The spring mandrel 410, the intermediate piece 420 and the lower mandrel 430 are serially interconnected using known mechanical interfaces such as threaded connections. The spring mandrel 410 includes an externally threaded end 412 that mates with the enlarged diameter portion 357 of the anvil 350. Similarly, the lower mandrel 430 includes a threaded portion 432 that engages complementary threads 434 formed on the bottom sub 210. As noted earlier, the bottom sub 210 is rigidly connected to the tool string lower section 24 via the adapter 600. Thus, it can be seen that a substantially rigid connection is made between the anvil 350 and the tool string lower section 24.

The mandrel assembly 400 also includes a passage 402 through which the telemetry link 500 extends from the wireline upper section 22 to the lower section 24 (FIG. 2). Like the housing upper assembly 220, the construction of the mandrel assembly 400 is known in the art and utilizes known features such as threaded pin-box connections and sealing members such as elastomeric "O"-rings. Accordingly, such features will not be discussed in detail. As noted earlier, the jarring tool 100 may be several feet in length. Accordingly, for ease of fabrication, handling, assembly, and maintenance, the mandrel assembly 400 is formed of the plurality of mandrels 410,420, and 430. Depending on the desired application, however, greater or fewer mandrels may be used.

Referring now to FIG. 2, the telemetry link 500 enables the exchange of data between the wireline upper housing 22 and lower section 24. During deployment of the tool string 10, data transmitted between the surface equipment 20 (FIG. 1) and the tool string 10 can electrically traverse the jarring assembly 300 via the telemetry link 500. Advantageously, this function is maintained during the jarring sequence for freeing the wireline 10 from a downhole obstruction 13 (FIG. 1). Referring now to FIGS. 3 and 6, a preferred telemetry link 500 includes first and second electrical sockets 502, 504 and a telescoping assembly 506. The electrical sockets 502, 504 provide an electrical interface between the telescoping assembly 506 and the tool string upper and lower sections 22,24, respectively. Such sockets are known in the art and will not be described in detail. The telescoping assembly 506 is formed at least partially of conductive material adapted to transmit electrical signals and includes at least two members that are electrically coupled through one or more mating surfaces. In a preferred embodiment, the telescoping assembly 506 has an insulation sleeve 507 and at least one inner tube 508 that is concentrically positioned within at least one outer tube 510. Preferably, at least a portion of the inner tube 508 is housed within the outer tube 510 during normal operations. A portion of the outer surface of the inner tube inner tube 508 is always in contact with a portion of the inner surface of the outer tube 510. These two mating surfaces electrically couple the inner tube 508 to the outer tube 510. The insulation sleeve 507 provides a mechanical and electrical barrier between the telescoping assembly 506 and the jarring tool 100.

As can be appreciated, the telescoping assembly can have a relatively fixed first axial length and a variable second axial length. During normal operations, the telescoping assembly has a relatively compact length, the first axial length, because a relatively long portion of the inner tube 508 is disposed within the outer tube 510. When needed, a portion of the inner tube 508 slides out of the outer tube 512, thereby increasing the length of the telescoping assembly 506. The telescoping assembly 506 adjusts or expands to accommodate the maximum axial travel of the upper assembly 220 relative to the bottom sub 210 or some intermediate variable length. Because the inner tube 508 and outer tube 512 maintain at least some mating surface, electrical signals can still travel between the wireline tubing upper and lower sections 22,24 via the telescoping assembly 506.

The telemetry link 500 is amenable to numerous embodiments. For example, although the sockets 502,504 are shown, other electrical connections such as plugs, pin-type connectors, or soldered wires may be used. Indeed, the sockets 502,504 may be dispensed with entirely if, for example, the telescoping assembly 506 is electrically integrated into the tool string 10. Furthermore, the members making up the telescoping assembly 506 may be strips, plates, wires, cables, or other elongated structures instead of tubing. The members need only be electrically coupled through mating surfaces that slide relative to each other. Additionally, the telescoping assembly 506 can use three or more members arranged in a telescoping relationship.

In the discussion below regarding the operation of the jarring tool, familiarity is presumed with the above discussed exemplary features of the exemplary preferred jarring tool. Accordingly, the numerals associated with these features are omitted for brevity. Furthermore, the described sequences and phases of operation are merely exemplary of certain embodiments of the present invention. One skilled in the art will understand that other embodiments may used different sequences and phases.

During use, the tool string and jarring tool are deployed into a well bore using a suspension line. If the lower portion of the tool string becomes stuck or otherwise immobile in the well bore, then the jarring tool has an initial condition wherein (a) the button member is in the first position, and (b) the anvil is immobile due to its connection to the tool string lower section via the mandrel assembly. The jarring sequence commences with an optional activation phase wherein the suspension line is drawn upwards to produce an axial traction force on the jarring tool housing. Because the housing bottom sub is fixed to the stuck tool string lower section, the frangible member connecting the bottom sub to the separator housing of the housing encounters a shearing force. Once this shearing force reaches a pre-determined value, the frangible member disintegrates and releases the separator housing and housing upper assembly from the bottom sub. This phase is optional because the jarring tool may be configured to be operated without necessarily having the housing separate.

Upon the shearing member snapping, jarring tool enters a loading phase wherein the housing upper assembly moves axially away (i.e., direction "U") from the tool string lower section. During this phase, the axial movement of the piston housing causes the piston head to engage one end of the biasing member. The hammer, which is positioned on the other end of the biasing member, is held stationary. As explained earlier, the button member is in the first position and thus prevents the hammer from sliding toward the anvil. Thus, the spring is compressed against the temporarily immobile hammer by the piston head. The axial movement of the housing upper assembly and piston housing thereby creates a compression force within the biasing member using the piston head. The axial movement of the housing also causes the ledge of the trigger housing to move towards the arcuate portion of the collar.

A release phase is entered upon the trigger ledge moving into interfering engagement with the arcuate portion of the collar. The axial movement of the trigger housing ledge in the "U" direction pushes the collar into the transverse bore of the hammer. It will be appreciated that, at this time, the piston head has compressed the biasing member a pre-determined amount. As the button moves from the first position to the second position, the passage of the collar and axial bore align with the sleeve portion of the anvil. Once aligned, the hammer is free to slide along the sleeve portion. The compressed biasing member, at this time, accelerates the hammer axially. In a projectile-type fashion, hammer travels along the sleeve portion and percussively strikes the base of the anvil. The anvil and connected mandrel assembly/tool string lower section are thereby urged in the generally "U" direction. This action in many instances will free the tool string lower section and allow the tool string to be retrieved from the well bore.

In certain instances, one or more hammer strikes may be needed to free the tool string. In these instances, the jarring tool is put into a reload phase. This phase is initiated by relieving the traction force on the tool string. The reduction of traction force permits the upper assembly to slide axially towards the lower assembly (i.e., direction "D"). During this movement, the pin end of the anvil housing contacts the hammer head and urges the hammer axially in direction "D". At the same time, the ledge of the trigger housing moves out of contact with the arcuate portion of the collar. Once the sleeve of the anvil exits the hammer axial bore and the collar passage, the spring member returns the collar from the second position to the first position. With the hammer and anvil interlocked by the button member, the jarring sequence can be again performed.

It will be appreciated that during the several phases of the jarring sequence, the axial length of the housing increases and decreases. The telemetry link accommodates the housing length change by a telescoping action. That is, after the bottom sub and housing upper assembly separate and as the housing upper assembly moves the "U" direction, the inner tube of the telemetry link is extracted out of the outer tube. Conversely, when the housing upper assembly moves toward the bottom sub, the inner tube slides into the outer tube. Thus, during all phases of the jarring sequence, a reliable telemetry communication path is maintained with the tool string lower section.

It should be understood that the terms such as "upper"/"lower" and "uphole"/"downhole" are intended only to clarify the relative orientation of any described feature or component. As is known, well bore may have highly deviated or even horizontal portions. Such well bore environments do not affect the functionality of the present invention. Furthermore, the above-described embodiments of the present invention provide a percussive or jarring force in a generally uphole direction. It would apparent to one skilled in the art, however, that the present invention may be arranged to provide a percussive or jarring force in a generally downhole direction.

Although illustrative embodiments of the invention have been shown and described, a wide range of modification, changes and substitution is contemplated in the foregoing disclosure. In some instances, some features of the present invention may be employed without a corresponding use of the other features. Accordingly, it is appropriate that the appended claims be construed broadly and in a manner consistent with the scope of the invention.

What is claimed is:

1. An apparatus for providing a jarring force to an object having at least a portion thereof lodged in a well bore, comprising:

an anvil, said anvil being connected to the portion of the object that is lodged in the well bore;

a hammer positioned adjacent said anvil, said hammer adapted to provide an impact force to said anvil when propelled by a propelling force; and a button associated with said hammer for selectively holding said hammer stationary relative to said anvil when said propelling force is being applied to said hammer.

2. The apparatus of claim 1 wherein said anvil includes a sleeve portion, said hammer includes a first bore for receiving said anvil sleeve portion, and wherein said button prevents said sleeve portion from entering said hammer first bore while in a first position, and allows sleeve portion to enter said hammer bore while in a second position.

3. The apparatus of claim 1 wherein said hammer includes a bore for receiving said button; and further comprising a spring member attached to said hammer, said spring member urging said button to a position for holding said hammer stationary relative to said anvil.

4. The apparatus of claim 1 further comprising a housing enclosing at least a portion of said hammer, said housing being movable relative to said hammer and having a trigger for actuating said button.

5. The apparatus of claim 1 wherein said anvil includes a sleeve portion, said hammer includes a first bore adapted to receive said sleeve portion and a second bore adapted to receive said button, said button including a passage offset from said first bore when in a first position and aligning with said first bore when in a second position, wherein the alignment of said first bore and said passage enables relative movement between said hammer and said anvil by permitting said sleeve portion to enter said hammer first bore.

6. The apparatus of claim 1 further comprising:

a housing enclosing at least a portion of said hammer and said anvil, said housing having a first section, a second section, and a frangible member connecting said first and second sections, said frangible member disintegrating upon encountering a pre-determined force and allowing said first and second sections to separate; and a telemetry link for exchanging electrical signals with the object; said link having at least one inner tube telescopically disposed within at least one outer tube; said at least one inner tube sliding out of said at least one outer tube when said first and second section separate.

7. A jarring tool for recovering a well bore object having a telemetry system, comprising:

an anvil, said anvil being connected to the portion of the object that is lodged in the well bore;

a hammer positioned adjacent said anvil, said hammer adapted to provide an impact force to said anvil when propelled by a propelling force;

a housing enclosing at least a portion of said hammer and said anvil, said housing having a first section releasably connected to a second section, said first section being adapted to actuate said hammer when disconnected from said second section; and a telemetry link in communication with the telemetry system of the well bore object, said link having at least two members arranged in a telescoping fashion, said link being adapted to transmit electrical signals across said housing.

8. The jarring tool of claim 7 wherein said at least two members comprise conductive tubing.

9. The jarring tool of claim 7 further comprising a button associated with said hammer; said button having a first position wherein said button holds said hammer stationary relative to said anvil, and a second position wherein said button allows said hammer to move relative to said anvil.

10. The jarring tool of claim 9 wherein said anvil includes a sleeve portion, said hammer includes a first bore for receiving said anvil sleeve portion, and wherein said button prevents said sleeve portion from entering said hammer first bore while in said first position, and allows sleeve portion to enter said hammer bore while in said second position.

11. The jarring tool of claim 9 wherein said hammer includes a bore for receiving said button; and further comprising a spring member attached to said hammer, said spring member urging said button from said second position to said first position.

12. The jarring tool of claim 9 wherein said housing encloses at least a portion of said hammer, said housing being movable relative to said hammer and having a trigger, said trigger moving said button from said first position to said second position when said housing moves relative to said hammer.

13. The jarring tool of claim 9 wherein said anvil includes a sleeve portion, said hammer includes a first bore adapted to receive said sleeve portion and a second bore adapted to receive said button, said button including a passage offset from said first bore when in said first position and aligning with said first bore when is said second position, wherein the alignment of said first bore and said passage enables relative movement between said hammer and said anvil by permitting said sleeve portion to enter said hammer first bore.

14. A method of freeing an object stuck in a well bore, comprising connecting an anvil to the object;

generating a propelling force;

applying the propelling force to a hammer;

restraining the hammer such that the hammer is substantially stationary relative to the anvil while the propelling force is applied to the hammer; and releasing the hammer.

15. The method of claim 14 further comprising returning the hammer to a position distal from the anvil.

16. The method of claim 14 wherein restraining the hammer is performed by a button member that provides a mechanical interference between the hammer and the anvil.

17. The method of claim 16 further releasing the hammer is performed by moving the button member from a first position to a second position.

18. The method of claim 14 further comprising maintaining communication with the object via at least two telescoping members.

19. The method of claim 18 further comprising providing a sliding relationship between the at least two telescoping member.

20. The method of claim 14 wherein restraining the hammer is performed by a collar having a bore that is radially offset from an axial bore of the hammer, the radial offset preventing the anvil from entering the axial bore of the hammer.

* * * * *